United States Patent [19]

Ogawa et al.

[11] Patent Number: 4,492,189

[45] Date of Patent: Jan. 8, 1985

[54] ROCKER COVER ASSEMBLY

[75] Inventors: Naoki Ogawa; Akira Toda, both of Yokosuka, Japan

[73] Assignee: Nissan Motor Company, Ltd., Yokohama, Japan

[21] Appl. No.: 398,708

[22] Filed: Jul. 15, 1982

[30] Foreign Application Priority Data

Jul. 16, 1981 [JP] Japan ..... 56-105539[U]

[51] Int. Cl.[3] ..... F01L 1/46

[52] U.S. Cl. ..... 123/90.38; 123/195 C

[58] Field of Search ..... 123/90.38, 195 C; 403/337, 336

[56] References Cited

U.S. PATENT DOCUMENTS

| | | | |
|---|---|---|---|
| 2,837,063 | 6/1958 | Martinez | 121/194 |
| 3,063,439 | 11/1962 | Kessel | 123/90.38 X |
| 3,090,463 | 5/1963 | Yarda | 123/195 C |

FOREIGN PATENT DOCUMENTS

| | | |
|---|---|---|
| 153839 | 12/1980 | Japan . |
| 163392 | 12/1980 | Japan . |
| 161941 | 12/1980 | Japan . |
| 517250 | 2/1972 | Switzerland . |
| 2052388A | 1/1981 | United Kingdom . |
| 2052388 | 1/1981 | United Kingdom . |

*Primary Examiner*—William R. Cline
*Assistant Examiner*—Peggy A. Neils
*Attorney, Agent, or Firm*—Schwartz, Jeffery, Schwaab, Mack, Blumenthal & Koch

[57] ABSTRACT

A rocker cover assembly comprises a rocker cover body made of damping material and including an installation flange section having a plurality of projections; a frame-like pressure-plate disposed in contact with the rocker cover body installation flange section and including an outer bent section to cover the outer periphery of the installation flange section, and a plurality of inner bent portions each of which is plunged into the installation flange section at a location where each projection of the rocker cover body installation flange section is formed; and a seal-ring located within a space defined between the pressure-plate outer bent section and the projections of the rocker cover body installation flange section, thereby maintaining a secure oil-tight seal between the rocker cover body and a cylinder head.

10 Claims, 9 Drawing Figures

ROCKER COVER ASSEMBLY

BACKGROUND OF THE INVENTION

1. Field of the Invention

This invention relates in general to a rocker cover assembly disposed on the top section of a cylinder head of an internal combustion engine, and particularly to the rocker cover assembly arranged to increase the rigidity of the installation section thereof onto the cylinder head and securely support in position a seal-ring in contact with the installation section.

2. Description of the Prior Art

In connection with rocker cover assemblies for use in internal combustion engines, it has been proposed to form a rocker cover body of a material having damping capacity for the purpose of noise reduction. Such a rocker cover body is formed along its periphery with an installation flange section which is to be secured onto a cylinder head. In order to install the rocker cover body onto the cylinder head, a rigid flat pressure-plate is used to press the rocker cover body installation flange section through a resilient seal-ring onto the cylinder head, because the damping material is usually lower in rigidity. However, with the thus arranged connection between the rocker cover body and the cylinder head, it is difficult to provide uniform pressure by the surface of the rocker cover body installation flange section onto the installation seat of the cylinder head, and to securely support the seal-ring in position, thereby resulting in oil leak.

SUMMARY OF THE INVENTION

A rocker cover assembly according to the present invention comprises a rocker cover body made of a material having damping capacity and including an installation flange section at which the rocker cover body is mounted on a cylinder head. The installation flange section is formed with a plurality of projections each of which projects toward the cylinder head. A frame-like pressure-plate is disposed on the rocker cover body installation flange section and includes an outer bent section to cover the periphery of the installation flange section, and a plurality of inner bent portions each of which is plunged into the installation flange section at a location where each projection of the rocker cover body installation flange section is formed. Additionally, a seal-ring is interposed between the cylinder head and the rocker cover body installation flange section and located within a space defined between the pressure-plate outer bent section and the projections of the rocker cover body installation section.

With this rocker cover assembly, the rigidity of the pressure-plate is grealy improved and therefore the pressure by the surface of the rocker cover body installation flange section becomes uniform throughout whole the surface thereof. Additionally, the seal-ring can be securely kept in position even if the slackening of the seal-ring is caused. Therefore, a secure oil-tight seal can be maintained between the rocker cover body and the cylinder head, thereby preventing oil leak therebetween.

BRIEF DESCRIPTION OF THE DRAWINGS

The features and advantages of the rocker cover assembly according to the present invention will be more clearly appreciated from the following description taken in conjunction with the accompanying drawings in which like reference numerals designate like parts and elements, and in which.

DETAILED DESCRIPTION OF THE INVENTION

Figure 1:
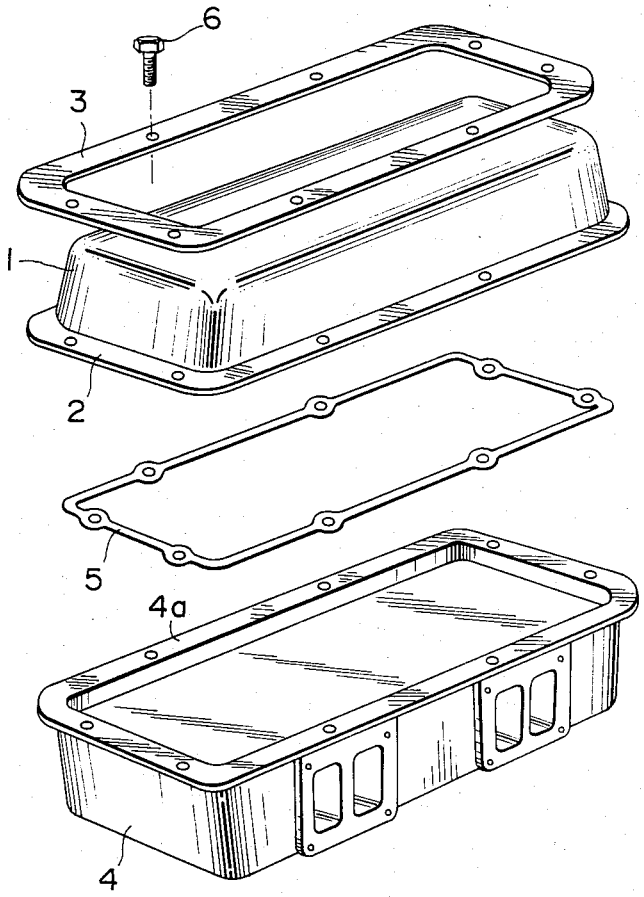
FIG.1 PRIOR ART
FIG. 1 is an exploded perspective view of a conventional rocker cover assembly.
Figure 2:
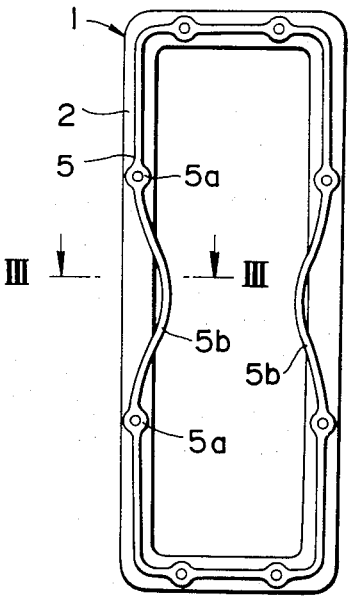
FIG. 2 PRIOR ART
FIG. 2 is a bottom view of the rocker cover assembly of FIG. 1.
Figure 3:
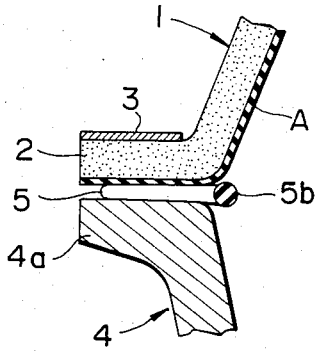
FIG. 3 PRIOR ART
FIG. 3 is an enlarged sectional view taken in the direction of arrows substantially along the line III—III of FIG. 2.

To facilitate understanding the present invention, a brief reference will be made to an example of conventional rocker cover assemblies, depicted in FIGS. 1 to 3. Referring to FIG. 1, the conventional rocker cover assembly is shown having a rocker cover body 1 which is made of high polymer material or fibrous material for engine vibration damping or noise reduction. The rocker cover body 1 is integrally formed along its periphery with an installation flange section 2. A frame-like metal pressure-plate 3 is disposed on the rocker cover body installation flange section 2 to cover the upper surface thereof. The rocker cover body flange section 2 is fixed onto an installation seat 4*a* of a cylinder head 4 through a seal-ring 5 disposed in contact with the lower surface of the rocker cover body installation flange section 2. The fixing of the rocker cover body flange section 2 is accomplished at a plurality of locations by means of bolts 6 each of which pierces the pressure-plate 3, the installation flange section 2 and the seal-ring 5 and is threaded into the cylinder head 4.

The pressure-plate 3 serves to reinforce the installation flange section 2 formed of a relatively soft damping material. The seal-ring 5 is made of an elastic material such as rubber so as to elastically support the rocker cover body 1, thereby preventing the rocker cover body from noise emission due to engine vibration transmission thereto. Additionally, the inner wall surface of the rocker cover body 1 is usually covered with an oil-impervious layer A as shown in FIG. 3.

However, with the thus arranged conventional rocker cover assembly, the pressure-plate is formed flat and has a simple rectangular cross-section and therefore it is insufficient in rigidity. As a result, when the pressure-plate is fastened by the bolts 6, the pressure caused by the surface of the pressure-plate is not uniform. The pressure is greater at the location of bolts 6 while the pressure decreases at locations between the bolts 6. Accordingly, it becomes difficult to maintain a secure oil-tight seal, thereby resulting in oil leaks. In addition, by fastening the seal-ring 5 through the rocker cover body flange section 2 by the bolts 6, the slackening of the seal-ring 5 might be gradually caused between the bolt-inserting sections 5*a* of the seal-ring 5 so that the thus slackened section 5*b* gets out of the installation seat 4*a* of the cylinder head 4 as shown in FIGS. 2 and 3. This gives rise to oil leaks and makes it impossible to provide a sufficient support of the rocker cover body installation flange section on the cylinder head.

Figure 4:
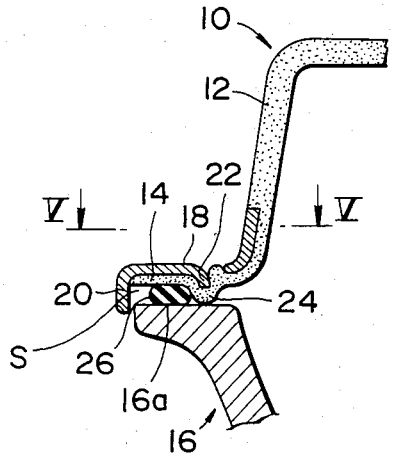
FIG. 4 a fragmentary sectional view of a preferred embodiment of a rocker cover assembly in accordance with the present invention.
Figure 5:
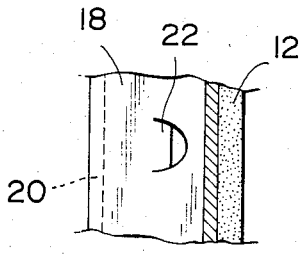
FIG. 5 is an enlarged sectional view taken in the direction of arrows substantially along the line V—V of FIG. 4.

In view of the above description of the conventional rocker cover assembly, reference is now made to FIGS. 4 to 9, and more specifically to FIGS. 4 and 5, wherein a preferred embodiment of a rocker cover assembly of the present invention is illustrated by the reference numeral 10. The rocker cover assembly 10 comprises a rocker cover body 12 made of a material having damping capacity which material contains high polymer material or fiber material. In this instance, the rocker cover body 12 is formed of a fibrous composite which is prepared by mixing organic and/or inorganic fiber with synthetic resin and its cross linking agent, and thereafter by forming the thus produced mixture into a predetermined shape upon heating and under pressure. The rocker cover body 12 is in the shape of a turned-down generally rectangular prism-type container. The rocker cover body 12 is integrally formed with an installation flange section 14 which is located at the bottom peripheral part of the rocker cover body 12 and continuously elongates along the bottom periphery of the rocker cover body 12. The installation flange section 14 is mounted on an installation seat 16*a* of a cylinder head 16, i.e., the rocker cover body 12 is installed through the installation flange section 14 on the cylinder head installation seat 16*a*. It will be understood that the inner wall surface of the rocker cover body 12 may be covered with an oil-impervious layer (such as one indicated by A in FIG. 3) made of rubber or the like as in the conventional rocker cover assembly.

A frame-like pressure-plate 18 is securely disposed on the rocker cover body 12 in a manner to cover at least the installation flange section 14, and made of a high rigidity material such as metal or hard plastics. The pressure-plate 18 is formed along its outer periphery with an outer bent section 20 which is formed by bending an outer peripheral part of a flat plate downward (as shown in the drawing) when the pressure-plate 18 is produced. The outer bent section 20 is formed in a manner to cover the outer periphery of the rocker cover body installation flange section 14. The pressure-plate 18 is further formed with a plurality of inner bent portions 22 each of which is formed by bending a portion of pressure plate 18 downwardly (as shown in the drawing). Each inner bent portion 22 is plunged into the rocker cover body installation flange section 14. As shown in FIG. 5, the inner bent portion 22 is formed by cutting the pressure-plate 18 in a semicircular shape and thereafter bending the semicircular pieces downwardly, in the case where the pressure-plate 18 is formed of metal plate.

Additionally, in connection with the above-mentioned outer bend section 20, the rocker cover body installation flange section 14 is formed with a plurality of projections 24 each of which projects downward in the drawing or toward the installation seat 16*a* of the cylinder head 16. Each projection 24 is positioned at a location corresponding to an inner bent portion 22. As shown, a space S is defined between the inner bent portion 22 and the outer bent section 20 which space is defined also between the lower surface of the rocker cover body installation flange section 14 and the installation seat 16*a* of the cylinder head 16. Disposed within the space S is a seal-ring 26 made of rubber or the like. The seal-ring 26 is securely interposed between the rocker cover body installation flange section 14 and the installation seat 16*a* of the cylinder head 16, maintaining fluid-tight and gas-tight seals. In addition, the pressure-plate 18, the rocker cover body installation flange section 14, and the seal-ring 26 are fixed with each other as a single unit by means of a plurality of bolts (not shown) piercing them and secured onto the cylinder head 16.

With the thus arranged rocker cover assembly 10, since the pressure-plate 18 is formed with the outer bent section 20, its cross-section becomes L-shaped and therefore its rigidity is considerably high. Moreover, the cross-section of the pressure-plate 18 becomes generally C-shaped in its parts having the inner bent portion 22, thereby exhibiting a further higher rigidity thereof. As a result, the pressure-plate 18 can uniformly transmit the fastening force due to the bolts (not shown) onto the rocker cover body installation flange section 14, thereby uniformalizing and increasing the pressure by the surface of the rocker cover body installation flange section 14. Accordingly, the installation flange section 14 strongly presses the seal-ring 26 against the cylinder head 16, thus obtaining a sufficient oil-tight seal.

It will be understood that there is a possibility that the slacking of the seal-ring 26 is gradually caused at a location between the bolts in the state where the seal-ring is put between the rocker cover body installation flange section 14 and the cylinder head 16. However, the thus formed slackened section of the seal-ring 26 can be prevented from moving by the projections 24 of the rocker cover body installation flange section 14 and the pressure-plate outer bent section 20, and therefore the seal-ring 26 cannot get out of the installation seat 16*a* of the cylinder head 16, thus attaining a secure oil-tight seal and a sufficient support function for the seal-ring 26. Furthermore, since the outer bent section 20 of the pressure-plate 18 covers the periphery of the installation flange section 14 of the rocker cover body 12, the installation flange section 14 can be prevented from oil absorption in the case where the installation flange section is made of a fibrous composite, thereby preventing the deterioration of sound-absorbing ability thereof.

Figure 6:
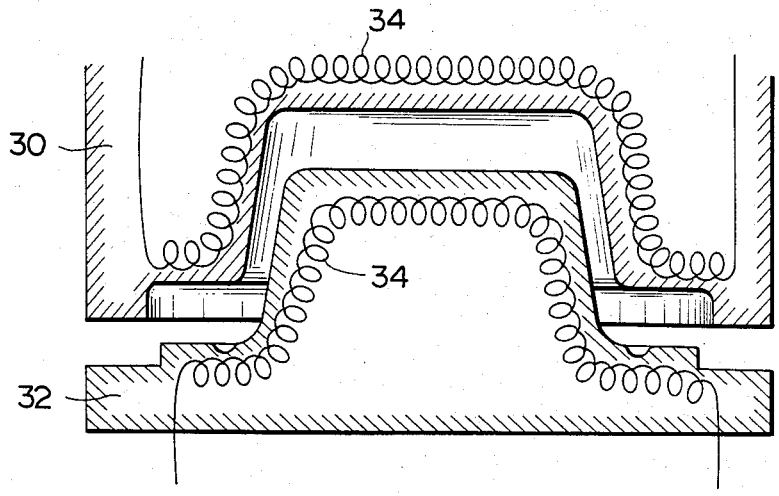
FIGS. 6 to 9 are sectional illustrations showing an example of a process of producing the rocker cover assembly in accordance with the present invention.
Figure 7:
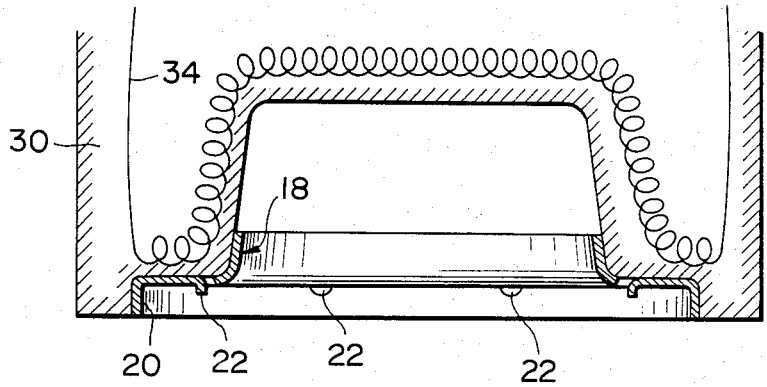

FIGS. 6 to 9 illustrate an example of a method for producing the rocker cover assembly 10. According to this method, upper and lower press dies 30, 32 are first prepared for achieving a press-forming process upon heating, as shown in FIG. 6. Accordingly, the upper and lower press dies 30, 32 are provided therein with heaters 34, 34, respectively. Thereafter, the pressure-plate 18 previously formed in a desired shape is temporarily installed onto the upper press die 30 as shown in FIG. 7.

Figure 8:
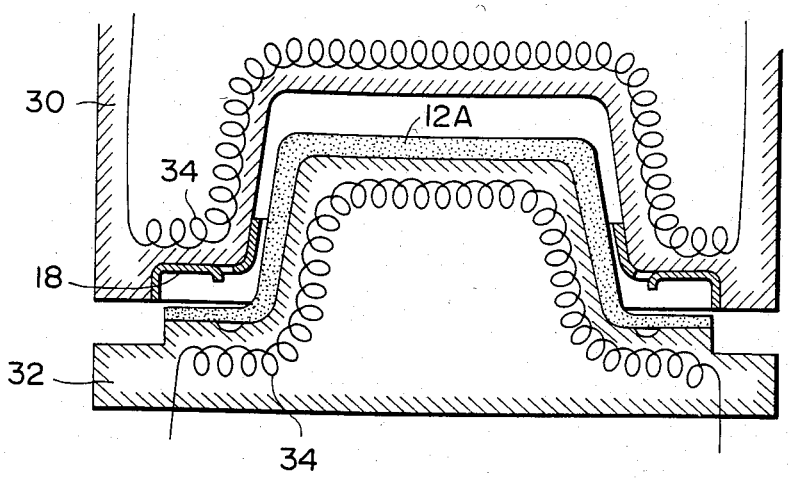
Figure 9:
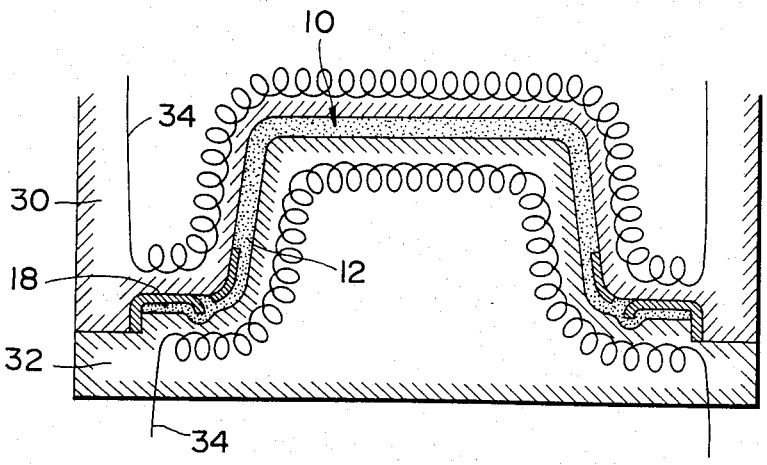

Additionally, as shown in FIG. 8, a damping material 12A is temporarily installed on the lower press die 32, which damping material has been previously formed generally in the shape of the rocker cover body 12. The damping material 12A is produced, for example, by preliminarily press-forming the fibrous composite upon heating which fibrous composite has been formed by mixing organic and/or inorganic fibers with synthetic resin and its cross linking agent. Subsequently, as shown in FIG. 9, the pressure-plate 18 and the damping material 12A are press-formed upon heating by the upper and lower press dies 30, 32 to be united, thereby obtaining the rocker cover assembly 10 without the seal-ring 26.

As appreciated from the above, according to the present invention, the pressure-plate covering the installation flange section of the rocker cover body is formed with the continuous outer bent section and a plurality of the inner bent portions. Accordingly, the cross-section of the pressure-plate is made L-shaped and partially C-shaped, thereby greatly improving the rigidity of the pressure-plate. This facilitates uniform transmission of the fastening force due to the bolts onto the rocker cover body flange section without forming any aperture, thereby obtaining a sufficient oil-tight seal. Additionally, since the outer bent section of the pressure-plate and the projections of the rocker cover body installation flange section securely support the seal-ring in contact with the installation flange section, the slackened section, if any, of the seal-ring cannot get out of a predetermined position, thus readily securing the oil-tight seal and the supporting function for the seal-ring without employing a core material such as wire within the seal-ring, while preventing a deterioration in appearance due to protruding of the slackened section of the seal-ring.

What is claimed is:

1. A rocker cover assembly for covering a cylinder head, comprising:

a rocker cover body made of a material having damping capacity and including an installation flange section at which said rocker cover body is mounted on the cylinder head, said installation flange section having a plurality of projections each of which projects toward the cylinder head;

a rigid frame-like pressure-plate disposed in contact with the rocker cover body installation flange section and including an outer bent section to cover the outer periphery of said installation flange section, and a plurality of inner bent portions each of which is plunged into said installation flange section at a location where a projection of said rocker cover body installation flange section is formed, said pressure plate being higher in rigidity than said rocker cover body; and a seal-ring interposed between the cylinder head and said rocker cover body installation flange section and located within a space defined between said pressure-plate outer bent section and the projections of said rocker cover body installation flange section.

2. A rocker cover assembly as claimed in claim 1, wherein said pressure-plate is generally L-shaped in cross-section.

3. A rocker cover assembly as claimed in claim 2, wherein said pressure-plate is generally C-shaped in cross-section along a vertical plane passing through the inner bent portion of said pressure-plate.

4. A rocker cover assembly as claimed in claim 1, wherein the outer bent section of said pressure-plate is formed continuously along the outer periphery of said pressure-plate.

5. A rocker cover assembly as claimed in claim 1, wherein each inner bent portion of said pressure-plate is located in the vicinity of a part of said rocker cover body corresponding to the inner periphery of the installation flange section of said rocker cover body.

6. A rocker cover assembly as claimed in claim 1, wherein said material having damping capacity is a fibrous composite containing fiber material and synthetic resin.

7. A rocker cover assembly as claimed in claim 1, wherein said pressure plate is made of metal.

8. A rocker cover assembly as claimed in claim 1, wherein said pressure plate is made of hard plastic.

9. A rocker cover assembly as claimed in claim 1, wherein said material having damping capacity consists of a high polymer.

10. A rocker cover assembly as claimed in claim 1, wherein said material having damping capacity consists of a fibrous composite.

* * * * *